US006811647B1

(12) United States Patent
Graf et al.

(10) Patent No.: US 6,811,647 B1
(45) Date of Patent: Nov. 2, 2004

(54) METHOD AND APPARATUS FOR THE PRODUCTION OF EXTRA-WIDE VENEERS

(75) Inventors: Matthias Graf, Eppingen (DE); John Holbert, Philomath, OR (US)

(73) Assignee: Dieffenbacher GmbH + Co. KG, Eppingen (DE)

( * ) Notice: Subject to any disclaimer, the term of this patent is extended or adjusted under 35 U.S.C. 154(b) by 0 days.

(21) Appl. No.: 09/546,287

(22) Filed: Apr. 10, 2000

(30) Foreign Application Priority Data

Apr. 9, 1999 (DE) ..... 199 16 041

(51) Int. Cl.[7] ..... B27D 1/00; B27D 1/04; B27D 1/10

(52) U.S. Cl. ..... 156/264; 156/256; 156/304.1; 144/346; 144/350; 144/351

(58) Field of Search ..... 156/266, 264, 156/258, 556, 304.1, 256, 304.3, 517, 304.5, 558; 144/346, 350, 351

(56) References Cited

U.S. PATENT DOCUMENTS 4,565,597 A * 1/1986 Schulte ..... 156/250
5,895,546 A * 4/1999 Bielfeldt et al. ..... 156/266

* cited by examiner

*Primary Examiner*—Richard Crispino
*Assistant Examiner*—Cheryl N. Hawkins
(74) *Attorney, Agent, or Firm*—Foley & Lardner LLP

(57) ABSTRACT

A method and an apparatus for producing extra-wide veneers and using them for the production of continuous laminated wood boards by gluing and pressing them from a chain of extra-wide veneers assembled in several layers over and behind one another. The method invention consists in the fact that the veneers arriving with a producible width and grain running crosswise are brought together end to end to form a chain of veneers, stitched together at the junctions or attached with adhesive tape and the veneers thus assembled are cut to a given oversize in the direction of the grain so that the seams or junctions between the veneers are distributed irregularly across the width of laminated boards, not in line one over the other.

6 Claims, 3 Drawing Sheets

METHOD AND APPARATUS FOR THE PRODUCTION OF EXTRA-WIDE VENEERS

FIELD OF INVENTION

The invention relates to a method and apparatus for producing extra-wide veneers and from them the production of endless laminated wood boards by gluing and pressing a chain of veneers combined from these extra-wide veneers one over the other and behind one another in a plurality of layers.

BACKGROUND OF THE INVENTION

In the production of laminated wood veneer boards by the method of DE 196 27 024 A1, veneers with a width of 1200 to 1400 millimeters are used exclusively today. The veneers are obtained by the peeling process from logs and then dried. The veneers shrink in the drying by about 0.2–0.3% in the direction of the grain and by 5–8% across the grain. Since the veneers do not shrink evenly, the width of a veneer accurately cut before drying varies after drying by about ±25 mm. After drying the veneers are sorted into various qualities and the appropriate classes of veneer are delivered to the production line for the production of laminated wood boards.

There they are stacked together to form a growing pack, and a previously defined outer edge of the pack serves as the alignment edge. The assembled veneer pack has on the alignment edge only a minimum misalignment between the individual veneers, which is due to the accuracy with which they were aligned and stacked. As a rule it amounts to ±10 mm and results in a maximum misalignment of 20 mm. On the opposite side the result is a misalignment of the veneer edges of typically 70 mm, composed of the sum of the alignment and stacking tolerances plus the tolerances in the veneer width.

After the pressing operation the finished veneer piece is trimmed on both sides so as to obtain clean edges. The trimming width is determined by the maximum offset of the veneers on the particular side.

Assuming a Gaussian normal distribution of the tolerances in the widths, the alignment and the stacking, the result is then a material loss of 50% of the trimming width, and consequently of 45 mm of the production width.

On the basis of a small production width of 1200 to 1400 mm, the result is a loss of material of 3.2 to 3.75%. In the manufacture of laminated veneer products the wood costs amount to 65 to 75% of the production costs. A reduction of the material losses is consequently very interesting from the economic point of view.

An increase in the production width first appears to be the most promising way. It is true that the width tolerances increase linearly with the width of the veneers, so that only uniform alignment and stacking tolerances will lead to a lower percentage of material loss. If, however, the overall process is considered, the greater the veneer width is, the less will be the yield from the log-peeling process, since it is harder to find continuous veneers of great width with no defects. Furthermore, it would be problematic in the peeling process to change the standard width, since a considerable percentage of the veneers produced will be found unsuitable for laminated wood boards when sorted afterward, due to insufficient strength and will find use as plywood veneer. It is furthermore advantageous if veneers can be purchased on the free market if needed. In the conventional production of veneers and veneer plywood, in which veneers of a standard width of 1330 mm are used and a trimmed board of 1220 mm can be produced with the stacking and alignment tolerances, 15 flanges can be made with a width of 75 mm with a saw kerf of 3 mm. A scrap with a width of 50 mm is wasted and goes into the shredder. That is another 4% loss of material.

The invention is addressed to the task of providing a method whereby laminated wood boards with extra-widths up to about 3600 mm can be made, these boards being suitable for the production of laminated veneer boards of optimum quality, and of creating an apparatus for the practice of the method.

SUMMARY OF THE INVENTION

As for the method, the accomplishment of this task consists in the fact that the veneers arriving one after the other with a producible width b and with the grain running transversely are combined to make a chain of veneers, sewn together or joined with adhesive tape at the meeting edges, and veneers with a given extra-width (B) are severed with the grain such that the seams or junctions in the chain of veneers are distributed irregularly across the width of the laminated wood board, not aligned one over the other.

The solution for an apparatus of the first embodiment consists in the fact that, in a continuously operating manner, veneers with their grain and their producible width oriented across the feed direction are lifted by the vacuum conveyor belt for transfer to a double belt conveyor system; following the double belt conveyor system the apparatus has a sewing machine for sewing together the abutments between two oncoming veneers, and the chain of veneers thus formed can be passed onto a second double conveyor belt system, the chain of veneers is severable by means of a cutting apparatus to a given length equal to the corresponding width of an extra-wide laminated veneer board, and that the extra-wide laminated veneer boards thus severed can be laid onto a feed belt running at right angles thereto, with their grain now running in the direction of the feed to the LVL production line.

The solution for an apparatus of a second embodiment consists in the fact that, in a continuously operating manner, veneers with their grain and their producible width running transversely across the feed direction are lifted from the vacuum conveyor belt for transfer to a double belt conveyor, the apparatus following the double belt conveyor has a sewing machine for sewing together the abutting edges of two veneers, and the chain of veneers thus formed can be transferred to a second double belt conveyor, the chain of veneers can be cut by a cutting apparatus to a given length equal to the corresponding width of an extra-wide laminated wood board, so that the extra-wide veneer pieces thus severed can be laid onto a pallet to form a supply stack.

With the method and apparatus according to the invention, the possibility is for the first time offered of adapting the production width in laminated wood manufacture to the width of the end product, i.e., to a multiple thereof, so as to avoid scraps left over after the finished board is divided up. Due to the starting veneer's width tolerance of ±25 mm and to the virtually perfect cut width of the laminated veneer boards, the junction d shifts irregularly within the extra-wide laminated veneer boards. The junction points d are thus distributed across the entire board and no longer constitute a weak point. Even the great gap that can form due to lack of trimming has no weakening effect on the finished product, since at no point are several junction points situated one over the other. Like the knotholes present in great numbers in the commonly used softwoods, the offset seams above and below in the laminated wood board compensate for one another; in other words, the composed veneer layers placed on top or below compensate for the weak point. Thus all sections of the laminated wood board can be used without exception for load-bearing components.

For the cover layers, i.e., top and bottom veneer of the laminated wood boards, the starting veneers can be trimmed before joining. Thus a rectilinear edge and a gap-free abutment between veneers can be obtained. For aesthetic reasons this is necessary for some applications. The loading stations must be provided with an additional knife for this purpose and a scanner to detect irregularity in the veneer edge. For special applications, however, all loading stations can be provided with the additional knife in order to obtain gap-free seams in all layers of the boards.

Additional advantageous measures and embodiments of the subject of the invention will be found in the subordinate claims and in the following description and drawing.

DETAILED DESCRIPTION OF THE PREFERRED EMBODIMENTS

Hereinafter, a first embodiment of the present invention will be described with reference to FIGS. 1–3.

Figure 1:
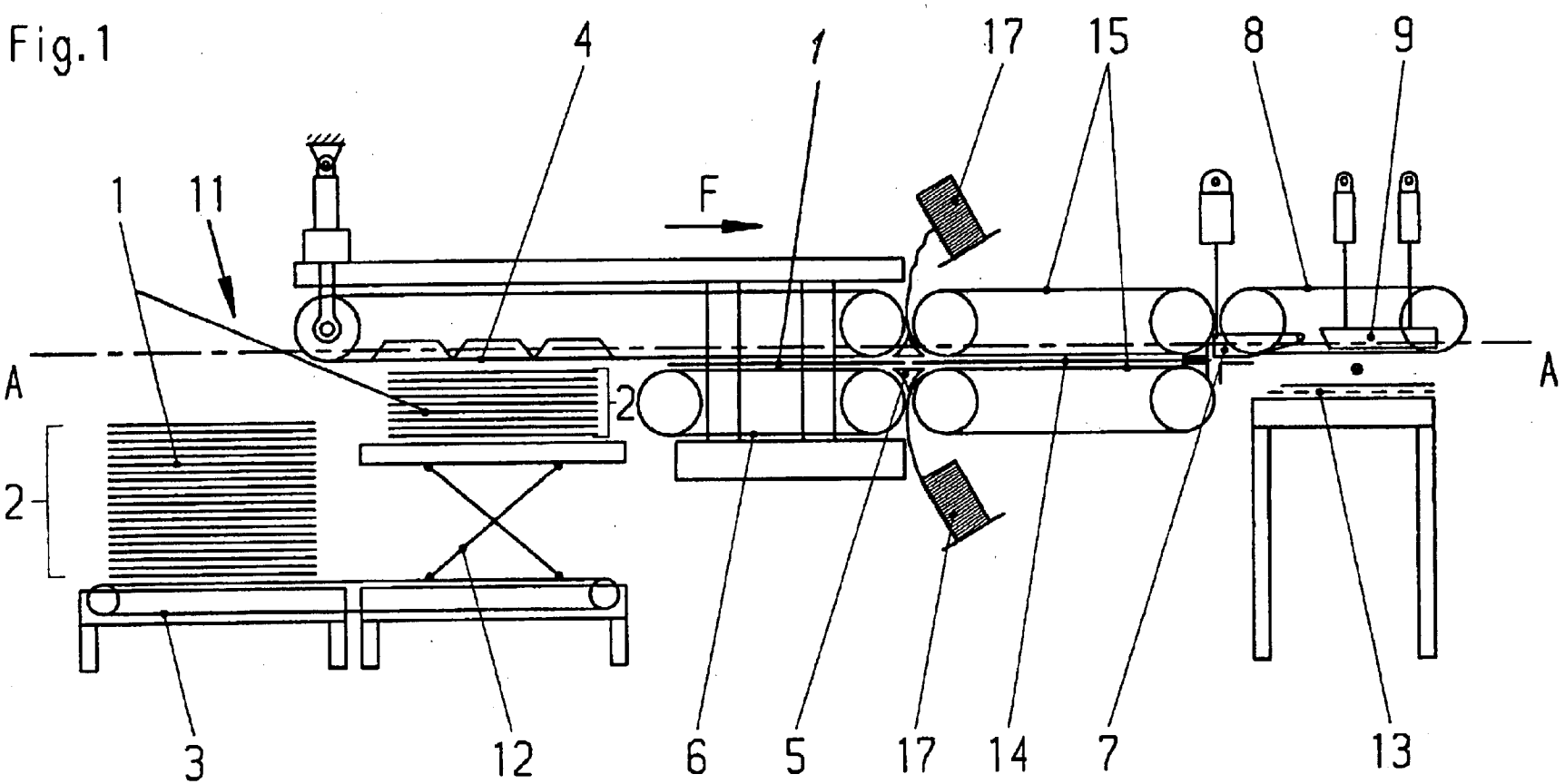
FIG. 1 shows the apparatus according to a first embodiment of the invention in a schematic representation and in a side view.
Figure 2:
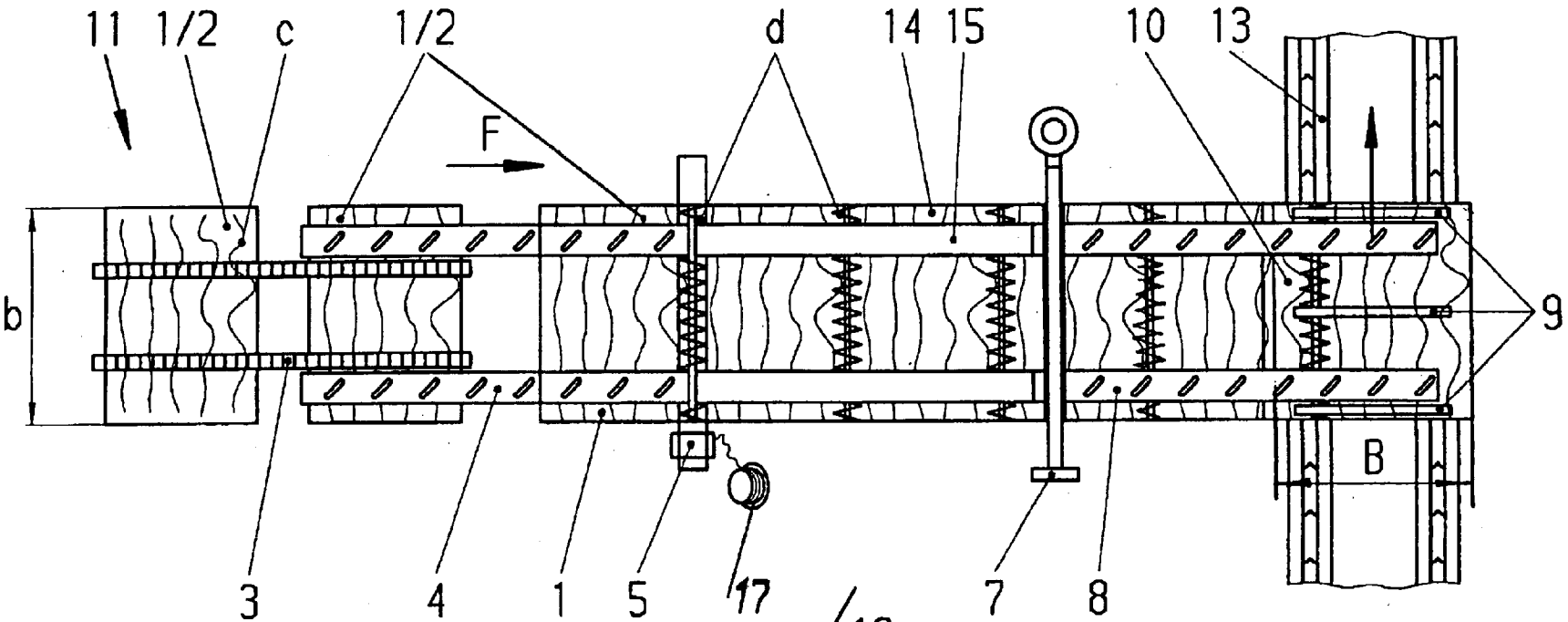
FIG. 2 shows the apparatus of FIG. 1 in a section A-A in a plan view.

The apparatus according to the first embodiment for the practice of the method comprises, as the main units in the loading direction F according to FIGS. 1 and 2, the supply stack station 11 with the supply stack 2, the scissors jack 12 for lifting to a level for the pickup of the veneers 1, the chain conveyor 3 for transporting a stack 2 on the scissors jack 12, the vacuum conveyor belt 4 for advancing one veneer 1 at a time to the stitching machine 5, the cutting apparatus 7 and the feeding conveyor belt 13. Advancing the veneers to the stitching machine 5 is performed by a double belt conveyor 6, and another double belt conveyor 15 carries them to the cutting apparatus 7. From the cutting apparatus 7 a second vacuum belt conveyor 8 takes over the veneer stack 10 cut to the width B and lays it by means of platens 9 onto the feed belt 13.

The invention now relates to a method and an apparatus by which veneers 1 of a standard width of, for example, 1330 mm, with a width tolerance of ±25 mm are assembled into extra-wide laminated veneer boards 10, preferably with a width of 2500 mm to 3600 mm and the latter are carried immediately after seaming onto the feed belt 13 of the LVL line. For this purpose the loading station of the LVL production line, which is already known today, for example according to DE 196 27 014, is provided with an additional apparatus for butting together, stitching and cutting the veneers 1 and the line 14 of bonded veneer boards. A standard LVL line has 8 loading stations so that different veneer qualities can be placed in the individual stacks of the end product.

In each of these loading stations the veneers 1 are taken from a supply stack by means of the vacuum conveyor belts 4 and carried with the grain running transversely onto a double conveyor belt system 6 which is additionally provided with pushing chains or pushing belts (not represented). The two conveyor belts are controlled independently of one another in speed and position. At the interface between the two belts the picked-up veneers 1 are put together with abutting point d against abutting point d, without first trimming the abutting edges. Thus junctions d are formed between the veneers 1 which are provided with numerous gaps e corresponding to the unevenness of the veneer edges. All of the picked-up veneers 1 are thus put together in a chain 14 of veneers. At the junctions d the veneers are sewn together with the yarn 17 by a sewing machine 5. As an alternative, the veneers 1 can also be joined together with beads of a hot adhesive or with strands of adhesive tapes applied to the top and bottom of the veneers 1. Then, in the cutting machine 7 with a single-edge knife, the joined veneers 10 are cut from the advancing veneer web 14 to a predetermined width B, preferably 3500 mm.

The single-edge knife assures that no losses of material will occur in the cutting. The width B of the joined veneers can be set on-line from the control station of the production line if the LVL board width or the width of the veneer plywood boards is to be changed. The joined veneers 10 are spaced apart under computer control on the feeder belt 13 of the LVL line.

Figure 3:
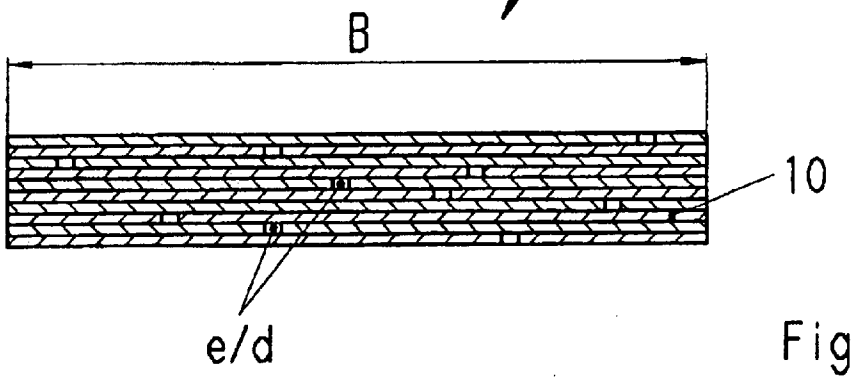
FIG. 3 shows in section the chain of laminated wood boards of a veneer pack.

FIG. 3 shows a section taken through a web assembled in multiple layers from the joined veneers 10 to form a pack 16 with the width B in an LVL production line for gluing and pressing in a continuously operating press. The seams e of the abutting edges d are thus always offset from one another.

In order to obtain an offset between the junctions d at the start of production, an end piece of varying length is cut from the advancing chain of veneers 14 at the eight loading stations before the first loading begins. The main application for the laminated veneer board according to the invention is the manufacture of flanges for the production of wooden I-beams. The width of the flange is in the range of 40 to 100 mm.

Figure 4:
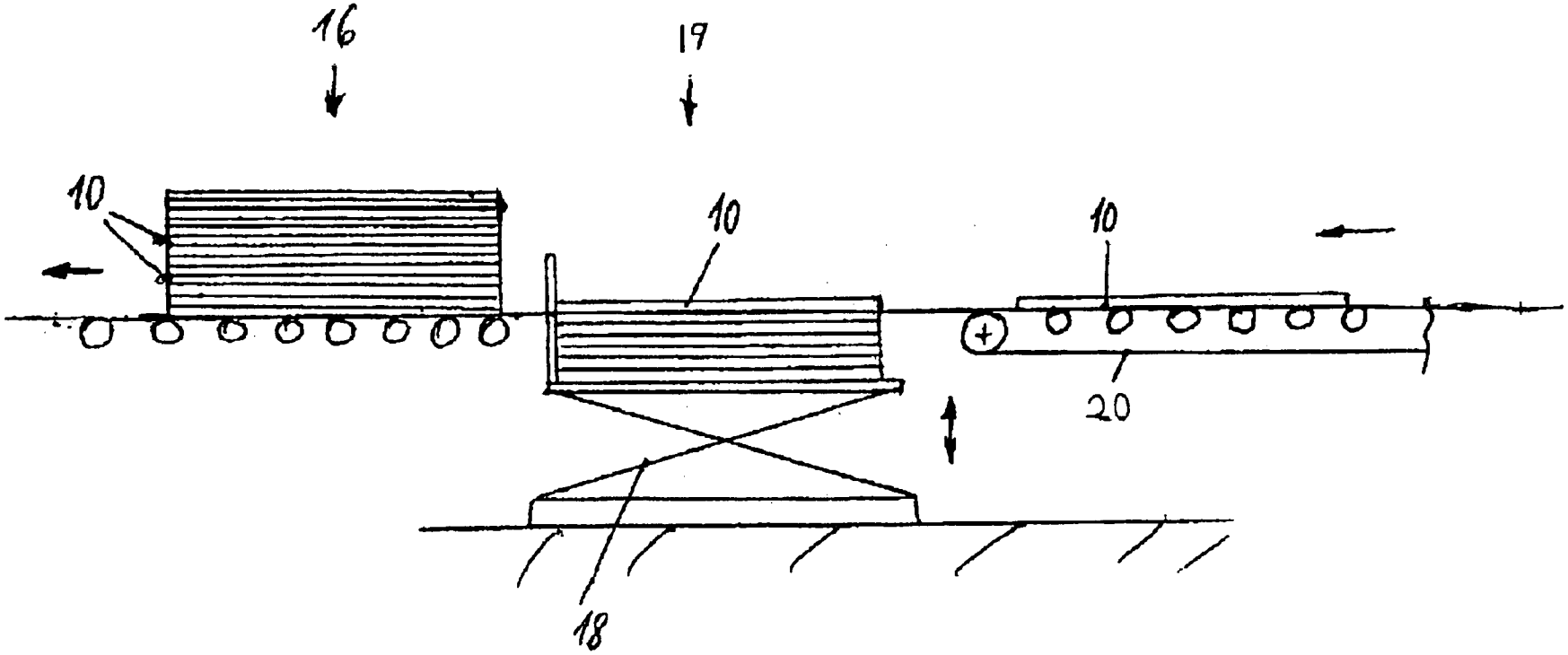
FIG. 4 shows the supply stack forming device of a second embodiment of the present invention.

Hereinafter, a second embodiment of the present invention will be described with respect to FIG. 4. The second embodiment is similar to the first embodiment except that supply stack forming device 19 replaces feeder belt 13 of the LVL line of the first embodiment.

An apparatus according to the second embodiment operates independently as a veneer preparation station built separately from the LVL production line. In this case the initial veneers are likewise taken from a supply stack 2, passed onto a double belt conveyor 6, optionally trimmed, then delivered to a sewing machine 5 and stitched or glued to form an endless chain of veneers. Then veneers 10 of any desired width B are cut from the endless chain of veneers with a single-edge knife in a cutting machine 7. Instead of laying the extra wide veneer boards 10 onto the feeder belt 13 of the LVL production line as is done in the first embodiment, the vacuum conveyor belt 8 lays the extra wide veneer boards 10 onto feeder belt 20 of the supply stack forming device 19. Like feeder belt 13 of the first embodiment, feeder belt 20 is positioned at a right angle to the double conveyor belt 15. Feeder belt 20 delivers the individual veneers 10 to the lifting platform 18. Veneers 10 are stacked on lifting platform 18 to form composed veneer assemblies 16 (supply stacks), which can be stored for later use in an LVL line.

In the second embodiment, a scissors-type articulated jack is used as lifting platform 18. However, other lifting devices such as a siphon lifter, which are known in the art, may also be used.

The veneer preparation plant thus operates independently and separately from the LVL production line. The supply stacks 16 thus formed with the over-wide veneers 10 are then delivered to the production line where they are further processed by the method described in U.S. Pat. Nos. 5,895,546 and 5,942,079, which are hereby incorporated by reference.

In contrast to the machinery described in the first embodiment the advantage is achieved of lower machinery costs. Only as many veneer preparation apparatus are needed as are actually required for the maximum output of the LVL production line. In the procedure described in the first embodiment, however, the number of preparation stations is determined by the number of the veneer feeding stations. Also, the availability of the production increases considerably if the veneer preparation system can operate independently.

The above description and drawings are illustrative only because modifications could be made without departing from the present invention, the scope of which is to be limited only by the following claims.

The priority document here, German Application No. DE 199 16 041.4, filed Apr. 9, 1999 (including its specification, drawings, and claims), is hereby incorporated by reference into this application.

We claim:

1. Method for the production of endless laminated veneer lumber (LVL), comprising:

abutting an edge of an individual veneer to an edge of another individual veneer and joining the individual veneers with adhesive tape or stitching in the vicinity of the abutments to assemble at least one strand of joined veneers, wherein the abutted edges run parallel to the grain of the individual veneers;

cutting at least one of the strands of joined veneers in a direction parallel to the grain to produce individual extra-wide joined veneers; and combining a plurality of individual extra-wide joined veneers by layering the individual extra-wide joined veneers to form endless LVL, wherein the general direction of the abutting edges of the individual veneers forming the individual extra-wide joined veneers comprising the LVL is generally the same, and wherein the individual extra-wide joined veneers are orientated in the LVL such that the abutting edges are not aligned with each other and are irregularly distributed in a cross-section of the LVL normal to the direction of the abutting edges.

2. Method of claim 1, wherein the joining together of the individual veneers to form a strand of joined veneers is performed with untrimmed abutting edges.

3. Method of claim 1, wherein the joining of the individual veneers to form a strand of joined veneers for covering layers of a LVL is performed with trimmed abutting edges.

4. A method for producing extra-wide joined veneers comprising the steps of:

a) providing oncoming veneers having a producible dimension b and grain running transversely one behind the other;

b) fastening together abutting edges of the oncoming veneers to form a strand of joined veneers having seams, wherein the seams are generally parallel to the direction of the grain; and c) repetitively cutting the strand of joined veneers in a direction of the grain to form individual extra-wide joined veneers with a given extra-width (B);

wherein the individual extra-wide joined veneers are cut off in step c) such that the seams are distributed irregularly over the width of the individual extra-wide joined veneers.

5. A method for producing extra-wide joined veneers comprising the steps of:

a) providing oncoming veneers having a producible dimension b and grain running transversely one behind the other;

b) fastening together abutting edges of the oncoming veneers to form a strand of joined veneers having seams, wherein the seams are generally parallel to the direction of the grain; and c) repetitively cutting the strand of joined veneers in a direction of the grain to form individual extra-wide joined veneers with a given extra-width (B);

wherein the individual joined veneers have only a single seam.

6. A method for the manufacture of endless laminated veneer lumber (LVL), comprising:

providing veneer boards with a producible length b;

bringing together the veneer boards one behind the other so that the veneer boards abut in a direction of the grain of the veneer boards;

stitching or joining the abutting veneer boards at the location of abutment to form a veneer board strand having seams at the locations of abutment;

cutting an over-wide veneer board of a given length from the veneer board strand in the direction parallel to the grain; and layering the over-wide veneer board in several layers over and behind one another to form endless LVL such that the seams of the individual over-wide veneer boards are distributed irregularly over the width of the LVL and are not aligned with one another, wherein the grain of the LVL runs parallel to the length of the LVL.

* * * * *